US006073271A

United States Patent [19]

Alexander et al.

[11] Patent Number: 6,073,271

[45] Date of Patent: Jun. 13, 2000

[54] FOOTBALL HELMET WITH INFLATABLE LINER

[75] Inventors: Cherie Alexander; Peter David Halstead, both of Knox; Brian Howard, Cookeville, all of Tenn.

[73] Assignee: Adams USA, Inc., Cookeville, Tenn.

[21] Appl. No.: 09/296,007

[22] Filed: Apr. 21, 1999

Related U.S. Application Data

[60] Provisional application No. 60/119,270, Feb. 9, 1999.

[51] Int. Cl.[7] ..... A42B 3/10

[52] U.S. Cl. ..... 2/413; 2/414

[58] Field of Search ..... 2/410, 411, 413, 2/414, 425

[56] References Cited

U.S. PATENT DOCUMENTS

| | | | |
|---|---|---|---|
| 3,600,714 | 8/1971 | Cade et al. | 2/413 |
| 3,761,959 | 10/1973 | Dunning . | |
| 3,849,801 | 11/1974 | Holt et al. | 2/413 |
| 3,906,546 | 9/1975 | Gooding | 2/413 |
| 4,060,855 | 12/1977 | Rappleyea | 2/413 |
| 4,566,137 | 1/1986 | Gooding . | |
| 5,864,063 | 12/1999 | Lakic | 2/413 |

FOREIGN PATENT DOCUMENTS

| | | | |
|---|---|---|---|
| 919352 | 1/1973 | Canada | 2/413 |

OTHER PUBLICATIONS

Schutt Sports Product Catalog 1996, pp. 1–9.

Riddell Youth Catalog Online, http://riddell1.com/.

*Primary Examiner*—Michael A. Neas

*Attorney, Agent, or Firm*—Stites & Harbison, PLLC; David W. Nagle, Jr.; Vance A. Smith

[57] ABSTRACT

A protective helmet incorporates an inflatable liner that has front, crown, rear, left and right side portions. To ensure uniform inflation, the inflatable liner is comprised of a plurality of inflatable cells interconnected by a series of air passageways. The liner has a front portion that extends to the lower edge of the helmet and a rear portion that extends below the external occipital protuberance of the wearer's head, thereby providing a snug, comfortable fit and ensuring that the helmet will not rise up or lift away from the wearer's head.

24 Claims, 4 Drawing Sheets

FOOTBALL HELMET WITH INFLATABLE LINER

This application claims priority from U.S. provisional application Ser. No. 60/119,270, filed Feb. 9, 1999.

BACKGROUND OF THE INVENTION

The present invention relates to protective headgear, specifically football helmets. To protect a player from skull fractures and to minimize the occurrence of head and scalp lacerations, typical football helmets are comprised of a rigid shell that contains a plurality of energy-absorbing pads. A wide variety of pads and pad configurations have been developed in the prior art in an effort to reduce the potential for injury by attenuating some translational energy of the force of an impact to the helmet. More recently, helmet manufacturers have also begun to incorporate inflatable bladders or liners into the helmets. Such liners are interposed between the padding in the helmet and provide for further attenuation of the translational energy associated with the force of an impact to the helmet. Because the liners can often be inflated while the helmet is being worn, they also allow for a more snug and personalized fit.

Prior art liners, however, have also presented some problems. For example, prior art liners are typically disposed toward the top portion of the helmet. As a result, when the liner is inflated, the helmet often rises up on the head. Also, with the liner disposed toward the top of the helmet, the helmet may not fit snugly around the periphery of the wearer's head.

A second problem is non-uniform inflation of the liner wherein some portions of the liner may be over-inflated whereas others are under-inflated. Such non-uniform inflation of the liner can adversely affect the fit of the helmet and the protection it provides. In prior art helmets, it is especially common for the portion of the liner adjacent the inflating valve to over-inflate and bulge out.

It is therefore an object of the present invention to provide a protective helmet that includes an inflatable liner and snugly fits on the wearer's head.

It is another object of the present invention to provide a protective helmet that includes an inflatable liner and does not rise up on the wearer's head when the liner is inflated.

It is still another object of the present invention to provide a protective helmet with an inflatable liner that uniformly inflates.

These and other objects and advantages of the present invention will become apparent upon a reading of the following description along with the appended drawings.

SUMMARY OF THE INVENTION

The present invention is a football helmet with an inflatable liner that has front, crown, rear, left and right side portions. The inflatable liner is comprised of a plurality of inflatable cells interconnected by a series of air passageways. The liner has a front portion that extends to the lower edge of the helmet and a rear portion that extends below the external occipital protuberance of the wearer's head, thereby providing a snug, comfortable fit and ensuring that the helmet will not rise up or lift away from the wearer's head.

DESCRIPTION OF THE PREFERRED EMBODIMENTS

Figure 1:
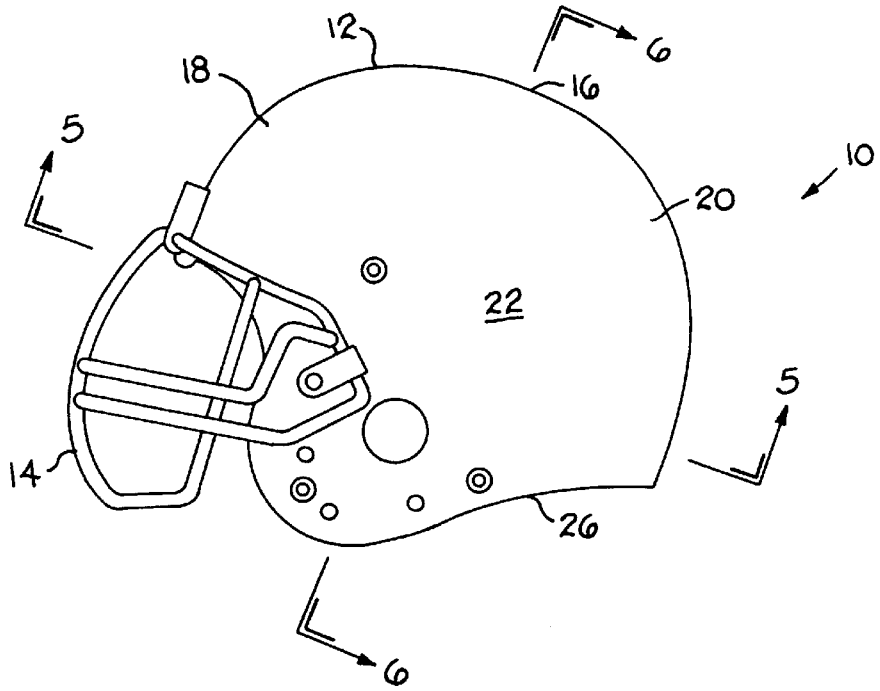
FIG. 1 is a side view of a football helmet with an inflatable liner made in accordance with the present invention.
Figure 2:
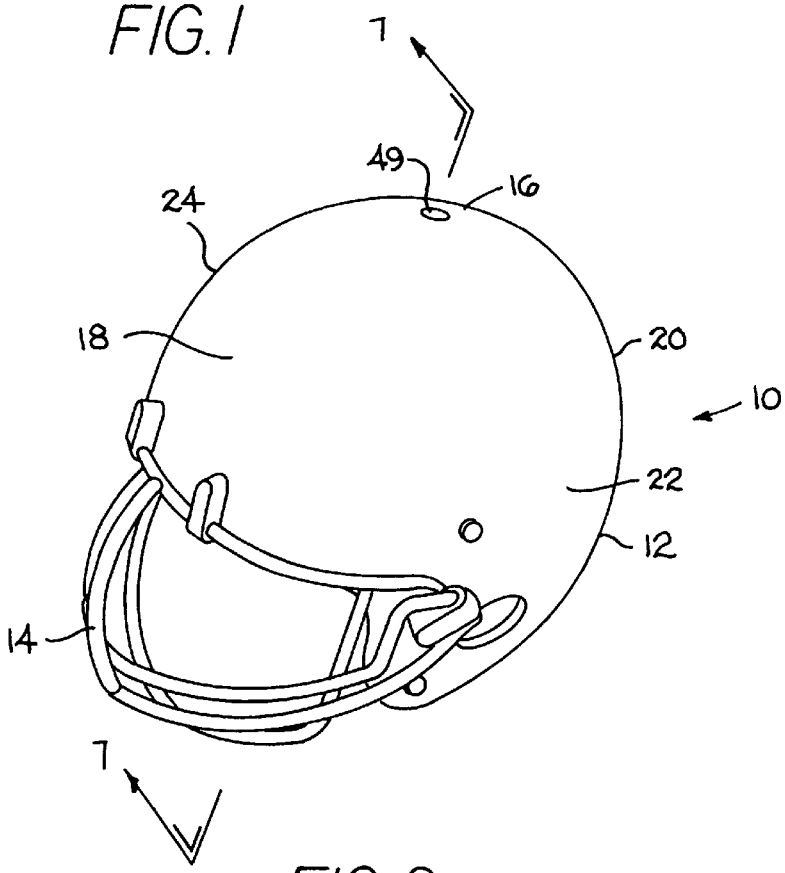
FIG. 2 is a perspective view of the football helmet of FIG. 1.

The present invention is an article of protective headgear, preferably a football helmet, that includes an inflatable liner having crown, front, rear, left and right side portions. As best shown in FIGS. 1 and 2, a preferred football helmet 10 made in accordance with the present invention is generally comprised of a rigid shell portion 12 and a face mask 14. The shell 12 is preferably constructed of an acrylonitrile butadiene styrene (ABS) alloy and has a crown portion 16, a front portion 18, a rear portion 20, a left portion 22, and a right portion 24. The shell 12 further defines a bottom opening 26 to receive a wearer's head, with the respective crown, front, rear, left and right portions of the shell 12 being shaped to surround and protect the wearer's skull and external head portions. Along the interior surface of the shell 12 are pads and the aforementioned inflatable liner that provide for some attenuation of the translational energy associated with the force of an impact to the shell 12, as will be further described below.

Figure 3:
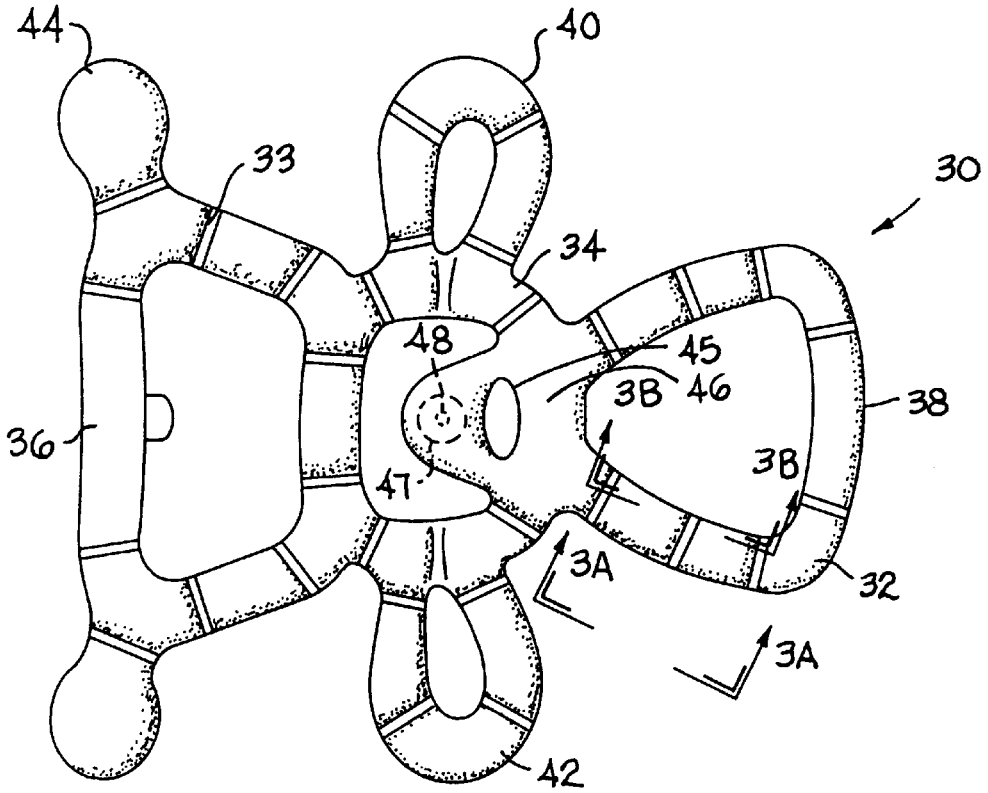
FIG. 3 is a plan view of the inflatable liner of the football helmet of FIG. 1.
Figure 3A:
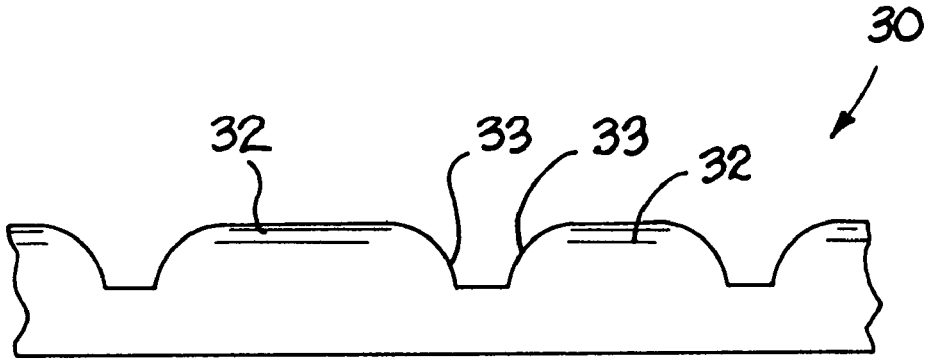
FIG. 3A is a side view of two adjacent cells of the liner taken along line 3A—3A of FIG. 3.
Figure 3B:
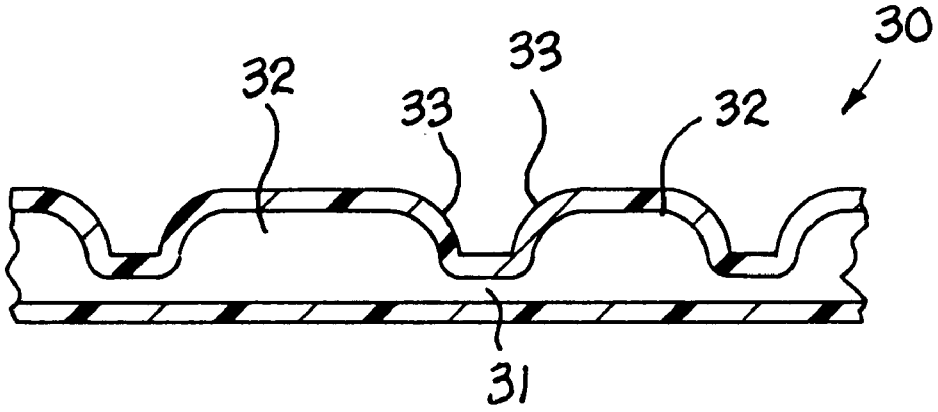
FIG. 3B is a side sectional view of two adjacent cells of the liner taken along line 3B—3B of FIG. 3.

Referring now to FIG. 3, the inflatable liner 30 of the present invention is preferably comprised of a plurality of inflatable cells 32 interconnected by a series of internal air passageways 31 (shown in FIG. 3B and described below). For ease of description, the liner 30 is laid out flat in the illustration of FIG. 3. It is preferred that this inflatable liner 30 be constructed of a synthetic rubber or thermal plastic elastomer capable of holding pressurized air. Such materials provide the needed flexibility for expansion and contraction, are durable, and are resistant to environmental degradation. Provided that these basic criteria are satisfied, other materials may also be used without departing from the spirit and scope of the present invention.

As stated above, the liner 30 is preferably comprised of a plurality of inflatable cells 32 separated by partial walls 33. FIG. 3A is a side view of two adjacent cells 32 of the preferred liner 30, and FIG. 3B is a sectional side view of the same adjacent cells 32 of the liner 30. These Figures show in greater detail the preferred structure of the liner 30, including the air passageway 31 that connects adjacent cells 32 and the partial walls 33 that separate adjacent cells 32. The structure of the partial walls 33 and the small cross-sectional area of the channel between adjacent cells 32 resist expansion to a greater degree than the cells 32 themselves when pressurized air is introduced into the liner 30, thereby providing a buffer against further expansion of the cells 32.

Thus, forming the liner 30 from a plurality of separate and spaced individual cells in this manner prevents over- inflation of individual portions of the liner 30. This provides for more uniform inflation of the liner 30. Furthermore, by forming the liner 30 from a series of interconnected cells 32, the liner 30 may easily be flexed or contorted (with the flexing of the liner 30 occurring predominantly along the partial walls 33) to fit inside of the shell 12 of the helmet 10. In this regard, it is also important to note that the rear surface of the liner 30, the surface that abuts the internal components of the helmet 10, is substantially flat, thereby providing for a smooth contact surface.

The preferred embodiment of the liner 30 shown in FIG. 3 has a central crown portion 34, a front portion 36, a rear portion 38, a left side portion 40, and a right side portion 42. The central crown portion 34 preferably has a generally circular shape. The front portion 36 has a generally trapezoidal shape, the smaller base of said trapezoid forming a portion of the circumference of the crown portion 34. For added comfort, in this preferred embodiment, the front portion 36 of the inflatable liner 30 also includes left and right temple pods 44 which extend from the lower corners of the front portion 36 and are adapted to rest against the wearer's temples on either side of his forehead. The rear portion 38 of the liner 30 has a generally triangular shape with the vertex of the triangle intersecting the circumference of the central crown portion 34, opposite the front portion 36. The left and right side portions 40, 42 of the liner 30 also each have a generally circular shape, each of said circles sharing a portion of their circumference with the circumference of the central crown portion 34.

At the intersection of the central crown portion 34 and the rear portion 38 of the liner 30 is an inflating cell 46. A preferably cylindrical boss 47 extends from the rear surface of this inflating cell 46 and houses a valve 48 that allows for inflation of the liner 30. This valve 48 is preferably a self-sealing valve that is opened and accessed through the insertion of an inflating needle. This type of valve is commonly used to inflate footballs and basketballs. As will be further discussed below, this valve 48 may be accessed by an inflating needle via a small opening 49 through the crown portion 16 of the helmet 10.

As mentioned above, over-inflation of portions of inflatable liners is a problem typical in the prior art. This becomes especially problematic in the areas adjacent the inflating valve. As can be seen in FIG. 3, the preferred geometry of the liner 30 results in an inflating cell 46 that is substantially larger than other cells 32. To prevent over- inflation of this particular cell 46, which would cause the entire helmet 10 to rise undesirably on the wearer's head, it is preferred that the inflating cell 46 have an annular configuration defining a molded opening 45 through the cell 46 which serves to structurally restrict the expansion of the cell 46 beyond an acceptable size.

Figure 4:
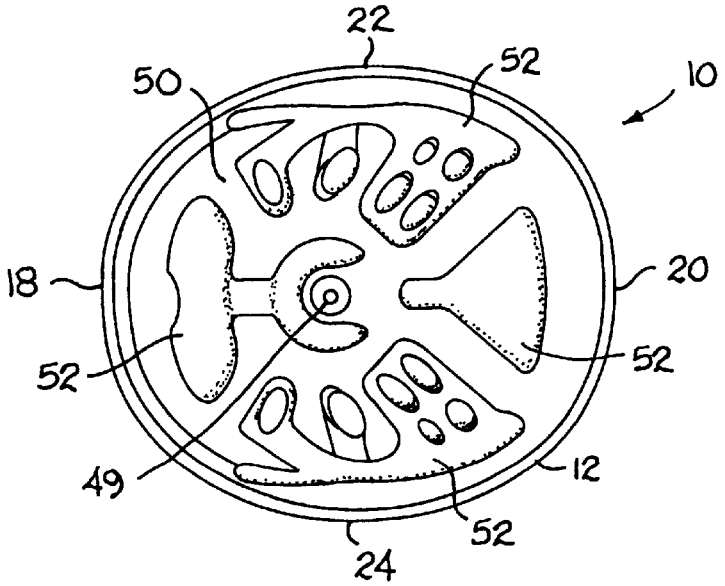
FIG. 4 is a bottom view of the shell portion of the football helmet of FIG. 1 with the inflatable liner removed to show the preferred positioning of the internal padding of the helmet.
Figure 5:
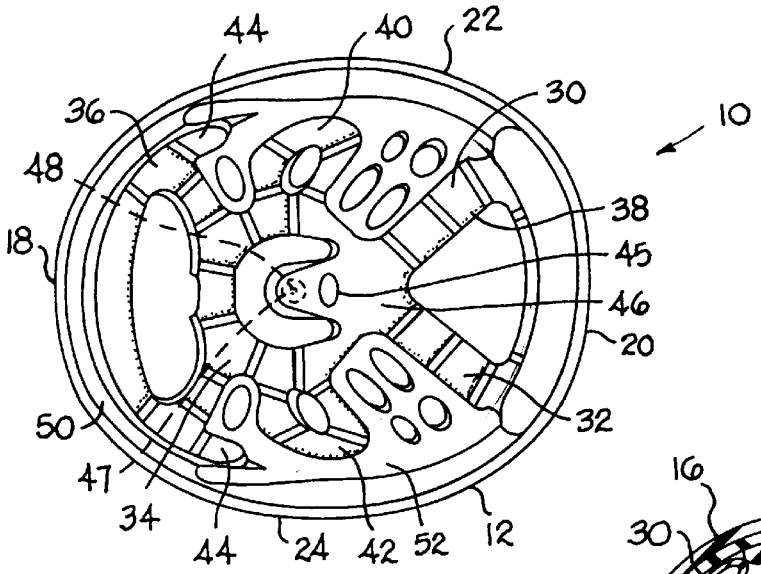
FIG. 5 is sectional view of the shell portion of the football helmet of FIG. 1 taken along line 5—5 of FIG. 1 and showing the preferred positioning of the internal padding and inflatable liner of the helmet.
Figure 6:
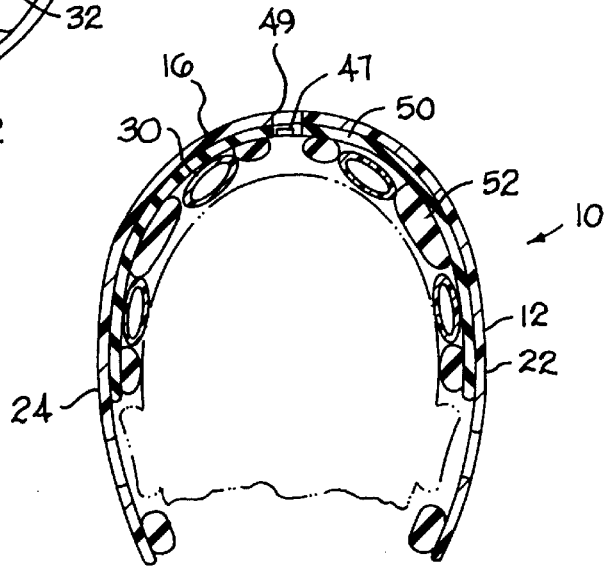
FIG. 6 is a sectional view of the football helmet of FIG. 1 taken along line 6—6 of FIG. 1.
Figure 7:
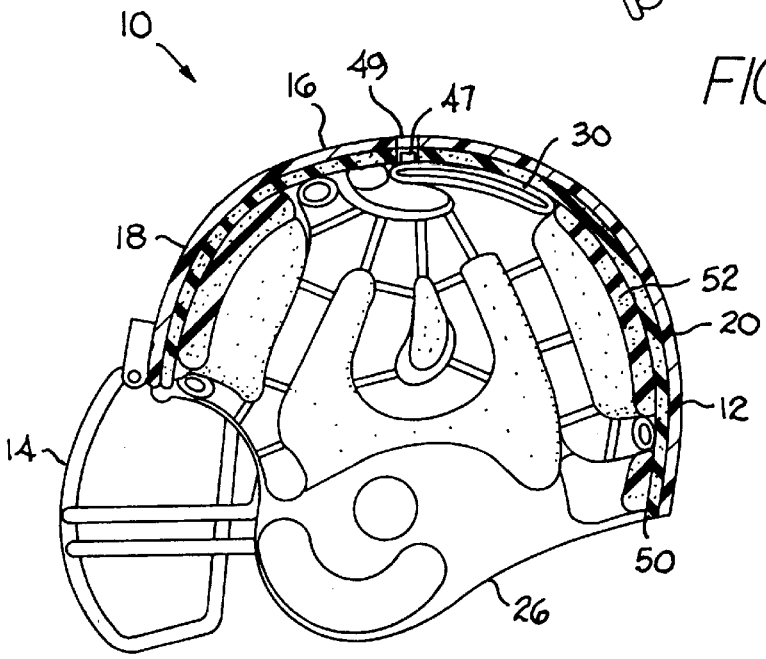
FIG. 7 is a sectional view of the football helmet of FIG. 1 taken along line 7—7 of FIG. 2.

FIG. 4 shows a preferred padding configuration that can be used in combination with the helmet 10 and preferred inflatable liner 30 described above. First, the interior surface of the shell 12 of this preferred helmet 10 is almost completely lined with a layer of polypropylene 50. This layer of polypropylene 50 aids in the attenuation of the translational energy associated with the force of an impact to the helmet 10. Individual foam pads 52 are then secured to the polypropylene layer 50. The pads 52 are constructed and positioned such that the preferred inflatable liner 30 can be fit between them, as shown in FIGS. 5–7 and described below. It is not necessary to secure the liner 30 to the polypropylene layer 50 or pads 52 provided that there is a sufficiently tight fit between the liner 30 and pads so that the liner 30 will not easily be dislodged when deflated.

FIGS. 5–7 best show how the liner 30 actually fits with the helmet 10. As shown in these Figures, the liner 30 is positioned within the shell 12 of the helmet 10 and is interposed between the interior padding 52 of the helmet 10. The shell 12 defines a small opening 49 through the crown portion 16 of the helmet 10 (as best shown on FIG. 2) that allows the valve 48 used to inflate/deflate the liner 30 to be accessed while the helmet 10 is being worn.

It is important to note that the front portion 36 of the liner 30 extends to the front edge of the helmet 10 as is defined by the bottom opening 26. Also, the rear portion 38 of the liner 30 extends downwardly past the external occipital protuberance, a prominent bony protrusion on the back a wearer's head. Because the liner 30 extends past the external occipital protuberance in the rear and down to the edge of the helmet 10 in the front, the helmet 10 will not rise up or lift away from the wearer's head when the liner 30 is inflated. To further aid in providing a snug and comfortable fit, the generally circular shape of the left and right side portions 40, 42 of the liner 30 provide a means for offsetting the geometric differences between the shape of the helmet 10 and the shape of the wearer's head.

The combination of the ABS shell 50, polypropylene layer 50, pads 52, and inflatable liner 30 results in a protective helmet 10 that snugly fits on a wearer's head and provides for attenuation of some of the translational energy associated with the force of an impact to the helmet. Once the wearer places the preferred helmet 10 on his head, it is a simple process to inflate the liner 30, requiring only the insertion of an inflating needle, that is operably connected to a pump, through the opening 49 defined by the crown portion 16 of the shell 12. The pump is then used to inflate the liner 30 until a snug and comfortable fit is achieved.

It will be obvious to those skilled in the art that modifications may be made to the preferred embodiments described herein without departing from the spirit and scope of the present invention.

What is claimed is:

1. A protective helmet adapted to receive and protect a wearer's head, comprising:

a rigid shell having crown, front, back, left and right portions shaped to protect the respective crown, front, back, left and right portions of the wearer's head, said shell defining a bottom opening and an internal cavity for receiving the wearer's head;

a plurality of pads within the internal cavity of said shell adapted to contact the wearer's head; and an inflatable liner comprised of a plurality of inflatable cells interconnected by a series of air passageways and interposed between said pads, said liner being adapted to contact the wearer's head and including a central crown portion positioned within the internal cavity of said shell adjacent the crown portion of said shell, a front portion positioned within the internal cavity of said shell adjacent the front portion of said shell, said front portion of the liner extending to a front edge of said shell along said bottom opening, a rear portion positioned within the internal cavity of said shell adjacent the rear portion of said shell, left and right side portions, positioned within the internal cavity of said shell adjacent the respective left and right portions of said shell, and a valve allowing for selective inflating and deflating of the liner.

2. A protective helmet as recited in claim 1, wherein the front portion of said liner includes a pair of inflatable cells that are adapted to rest against the left and right temples of the wearer.

3. A protective helmet as recited in claim 1, wherein:

the central crown portion of said liner comprises a ring of interconnected inflatable cells;

the front portion of said liner includes two front appendages of interconnected inflatable cells operably connected to and extending from said crown portion, said front appendages terminating at the front edge of said shell and being connected by a front lateral member of one or more interconnected inflatable cells along the front edge of said shell; and the rear portion of said liner includes two rear appendages of interconnected inflatable cells operably connected to and extending from said crown portion, said rear appendages being connected by a rear lateral member of one or more interconnected inflatable cells.

4. A protective helmet as recited in claim 3, wherein the left and right side portions of said liner each are comprised of a ring of interconnected inflatable cells that starts from and terminates at the crown portion of said liner.

5. A protective helmet as recited in claim 4, wherein the front portion of said liner further includes a pair of inflatable cells that are positioned at the intersections of the front appendages and the front lateral member and are adapted to rest against the left and right temples of the wearer.

6. A protective helmet as recited in claim 1, wherein the central crown portion of said liner comprises a ring of interconnected inflatable cells that include an inflating cell, said inflating valve being housed in the inflating cell and being accessible through an opening in the crown portion of said shell.

7. A protective helmet as recited in claim 6, wherein the inflating cell defines an opening that structurally limits expansion of the inflating cell.

8. A protective helmet adapted to receive and protect a wearer's head, comprising:

a rigid shelf having crown, front, back, left and right portions shaped to protect the respective crown, front, back, left and right portions of the wearer's head, said shell defining a bottom opening and an internal cavity for receiving the wearer's head;

a plurality of pads within the internal cavity of said shell; and an inflatable liner having crown, front, back, left and right side portions, each portion of the liner being associated with the respective shell portions of the helmet and positioned adjacent said pads, each of said liner portions being comprised of a multiplicity of inflatable cells spaced apart by interconnecting sections that place said cells in gaseous communication, each of said interconnecting sections having a cross-section smaller than that of said cells when uninflated so as to resist inflation and provide increased flexibility of the liner when said liner is inflated along said interconnecting sections, said crown portion of the liner having an inflating cell housing an inflating valve, and said inflating cell having an annular configuration defining a central opening to minimize expansion of said inflating cell beyond a predetermined size, thereby preventing said helmet from riding too high on the wearer's head.

9. A protective helmet as recited in claim 8, wherein each of said liner portions has a ring configuration with said crown portion of the liner being connected to said front, rear, left and right side portions.

10. A protective helmet adapted to receive and protect a wearer's head, comprising:

a rigid shell having crown, front, back, left and right portions shaped to protect the respective crown, front, back, left and right portions of the wearer's head, said shell defining a bottom opening and an internal cavity for receiving the wearer's head;

a plurality of pads within the internal cavity of said shell; and an inflatable liner comprised of a plurality of inflatable cells interconnected by a series of air passageways and interposed between said pads, said liner including a central crown portion positioned within the internal cavity of said shell adjacent the crown portion of said shell, a front portion positioned within the internal cavity of said shell adjacent the front portion of said shell, said front portion of the liner extending to a front edge of said shell along said bottom opening, and said front portion including a pair of inflatable cells that are adapted to rest against the left and right temples of the wearer, a rear portion positioned within the internal cavity of said shell adjacent the rear portion of said shell, left and right side portions, positioned within the internal cavity of said shell adjacent the respective left and right portions of said shell, and a valve allowing for selective inflating and deflating of the liner.

11. A protective helmet adapted to receive and protect a wearer's head, comprising:

a rigid shell having crown, front, back, left and right portions shaped to protect the respective crown, front, back, left and right portions of the wearer's head, said shell defining a bottom opening and an internal cavity for receiving the wearer's head;

a plurality of pads within the internal cavity of said shell; and an inflatable liner comprised of a plurality of inflatable cells interconnected by a series of air passageways and interposed between said pads, said liner including a central crown portion comprised of a ring of interconnected inflatable cells and positioned within the internal cavity of said shell adjacent the crown portion of said shell, a front portion positioned within the internal cavity of said shell adjacent the front portion of said shell, said front portion of the liner extending to a front edge of said shell along said bottom opening, a rear portion positioned within the internal cavity of said shell adjacent the rear portion of said shell, left and right side portions, positioned within the internal cavity of said shell adjacent the respective left and right portions of said shell, and a valve allowing for selective inflating and deflating of the liner.

12. A protective helmet as recited in claim 11, wherein:

the front portion of said liner includes two front appendages of interconnected inflatable cells operably connected to and extending from said crown portion, said front appendages terminating at the front edge of said shell and being connected by a front lateral member of one or more interconnected inflatable cells along the front edge of said shell; and the rear portion of said liner includes two rear appendages of interconnected inflatable cells operably connected to and extending from said crown portion, said rear appendages being connected by a rear lateral member of one or more interconnected inflatable cells.

13. A protective helmet as recited in claim 12, wherein the left and right side portions of said liner each are comprised of a ring of interconnected inflatable cells that starts from and terminates at the crown portion of said liner.

14. A protective helmet as recited in claim 13, wherein the front portion of said liner further includes a pair of inflatable cells that are positioned at the intersections of the front appendages and the front lateral member and are adapted to rest against the left and right temples of the wearer.

15. A protective helmet as recited in claim 11, wherein the ring of interconnected inflatable cells comprising the central crown portion includes an inflating cell, said inflating valve being housed in the inflating cell and being accessible through an opening in the crown portion of said shell.

16. A protective helmet as recited in claim 15, wherein the inflating cell defines an opening that structurally limits expansion of the inflating cell.

17. A protective helmet adapted to receive and protect a wearer's head, comprising:

a rigid shell having crown, front, back, left and right portions shaped to protect the respective crown, front, back, left and right portions of the wearer's head, said shell defining a bottom opening and an internal cavity for receiving the wearer's head;

a plurality of pads within the internal cavity of said shell adapted to contact the wearer's head; and an inflatable liner interposed between said pads and comprised of a plurality of inflatable cells, each of said individual cells being separated from adjacent cells by partial walls, and each of said individual cells being connected to adjacent cells by one or more air passageways having an internal cross-sectional diameter smaller that that of said individual cell;

wherein said liner has a first side adapted to contact the wearer's head; and wherein said liner has a substantially flat second side adapted to abut said shell, thereby allowing said liner to be flexed and fit within said shell with the second side of the liner allowing a smooth contact surface to be maintained between said liner and said shell.

18. A protective helmet as recited in claim 17, wherein said liner includes:

a central crown portion positioned within the internal cavity of said shell adjacent the crown portion of said shell, a front portion positioned within the internal cavity of said shell adjacent the front portion of said shell, a rear portion positioned within the internal cavity of said shell adjacent the rear portion of said shell, left and right side portions, positioned within the internal cavity of said shell adjacent the respective left and right portions of said shell, and a valve allowing for selective inflating and deflating of the liner.

19. A protective helmet as recited in claim 18, wherein the front portion of said liner includes a pair of inflatable cells that are adapted to rest against the left and right temples of the wearer.

20. A protective helmet as recited in claim 18, wherein:

the central crown portion of said liner comprises a ring of interconnected inflatable cells;

the front portion of said liner includes two front appendages of interconnected inflatable cells operably connected to and extending from said crown portion, said front appendages terminating at the front edge of said shell and being connected by a front lateral member of one or more interconnected inflatable cells along the front edge of said shell; and the rear portion of said liner includes two rear appendages of interconnected inflatable cells operably connected to and extending from said crown portion, said rear appendages being connected by a rear lateral member of one or more interconnected inflatable cells.

21. A protective helmet as recited in claim 20, wherein the left and right side portions of said liner each are comprised of a ring of interconnected inflatable cells that starts from and terminates at the crown portion of said liner.

22. A protective helmet as recited in claim 21, wherein the front portion of said liner further includes a pair of inflatable cells that are positioned at the intersections of the front appendages and the front lateral member and are adapted to rest against the left and right temples of the wearer.

23. A protective helmet as recited in claim 18, wherein the central crown portion of said liner comprises a ring of interconnected inflatable cells that include an inflating cell, said inflating valve being housed in the inflating cell and being accessible through an opening in the crown portion of said shell.

24. A protective helmet as recited in claim 23, wherein the inflating cell defines an opening that structurally limits expansion of the inflating cell.

* * * * *